US010101102B2

(12) United States Patent
Eitan et al.

(10) Patent No.: US 10,101,102 B2
(45) Date of Patent: Oct. 16, 2018

(54) MAGAZINE WELL FOR A FIREARM

(71) Applicant: Magpul Industries Corp., Austin, TX (US)

(72) Inventors: Yehezkel Eitan, Johnstown, CO (US); Timothy Eric Roberts, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/222,526

(22) Filed: Jul. 28, 2016

(65) Prior Publication Data

US 2017/0030667 A1 Feb. 2, 2017

Related U.S. Application Data

(60) Provisional application No. 62/199,597, filed on Jul. 31, 2015.

(51) Int. Cl.

| | |
|---|---|
| ***F41A 3/66*** | (2006.01) |
| ***F41A 11/02*** | (2006.01) |
| ***F41A 17/38*** | (2006.01) |
| ***F41A 19/11*** | (2006.01) |

(52) U.S. Cl.

CPC ..... *F41A 3/66* (2013.01); *F41A 11/02* (2013.01); *F41A 17/38* (2013.01); *F41A 19/11* (2013.01)

(58) Field of Classification Search

CPC ..... F41A 9/65; F41A 9/70; F41A 3/66; F41A 11/02

USPC ..... 42/50

See application file for complete search history.

(56) References Cited

U.S. PATENT DOCUMENTS

| | | | | |
|---|---|---|---|---|
| 2,956,363 | A * | 10/1960 | Montana | F41A 17/38 42/18 |
| 2,997,803 | A | 8/1961 | Florence | |
| 3,803,739 | A * | 4/1974 | Haines | F41A 9/70 42/50 |
| 4,237,638 | A | 12/1980 | Trexler | |
| D640,766 | S | 6/2011 | Joplin | |

(Continued)

FOREIGN PATENT DOCUMENTS

| | | |
|---|---|---|
| DE | 19743557 C1 | 3/1999 |
| EP | 2661599 A1 | 11/2013 |

(Continued)

OTHER PUBLICATIONS

European Patent Office, "Invitation to Respond Re Application No. 16182255.6", dated Feb. 6, 2017, p. 2, Published in: EP.

(Continued)

*Primary Examiner* — Stephen Johnson

(74) *Attorney, Agent, or Firm* — Neugeboren O'Dowd PC

(57) ABSTRACT

A magazine well unit and a method are disclosed. The magazine well unit may have an upper portion having a firearm interface; a lower portion; a proximal portion; and a distal portion. The distal portion may have a magazine well to removably receive a box magazine. The magazine well may have at least one fore stop and at least one aft stop, the at least one fore stop and the at least one aft stop shaped to prevent the box magazine from passing beyond the upper portion of the magazine well unit. At least one of the fore stop or the aft stop may have an upper portion region having a surface for engaging the firearm.

19 Claims, 15 Drawing Sheets

(56) References Cited

U.S. PATENT DOCUMENTS

| | | | | |
|---|---|---|---|---|
| 7,963,062 | B1 | 6/2011 | Rotharmel et al. | |
| 8,434,253 | B2 | 5/2013 | Cain et al. | |
| 8,667,723 | B2 * | 3/2014 | Bentley | F41A 9/59 42/49.01 |
| 8,832,987 | B2 | 9/2014 | Addis | |
| 8,881,444 | B2 | 11/2014 | Warburton et al. | |
| 8,904,692 | B2 | 12/2014 | Ballard | |
| 8,931,200 | B2 | 1/2015 | Pratt | |
| 8,931,393 | B1 | 1/2015 | Vincent et al. | |
| 8,935,872 | B2 | 1/2015 | Zukowski | |
| 8,959,818 | B2 | 2/2015 | Mayerl | |
| 8,984,790 | B2 | 3/2015 | Wilson et al. | |
| 9,003,685 | B1 * | 4/2015 | Huang | F41A 19/11 42/70.07 |
| 9,074,839 | B2 | 7/2015 | Warburton | |
| 9,091,505 | B1 | 7/2015 | Battaglia | |
| 9,140,506 | B2 | 9/2015 | Gomez | |
| 9,151,553 | B2 | 10/2015 | Constant et al. | |
| D744,055 | S | 11/2015 | Bitz | |
| D745,623 | S | 12/2015 | Flores | |
| D745,940 | S | 12/2015 | Flores | |
| 9,234,717 | B2 | 1/2016 | Jarboe | |
| 9,267,750 | B1 | 2/2016 | Tubb | |
| 9,273,929 | B2 | 3/2016 | Sugg | |
| 2011/0173859 | A1 | 6/2011 | Findlay | |
| 2011/0232148 | A1 | 9/2011 | Cain et al. | |
| 2012/0085009 | A1 | 4/2012 | Crow | |
| 2012/0137556 | A1 | 6/2012 | Laney et al. | |
| 2014/0060310 | A1 * | 3/2014 | Overstreet | F41A 3/68 89/138 |
| 2014/0165440 | A1 | 6/2014 | Mayerl | |
| 2015/0000171 | A1 | 1/2015 | Roberts | |
| 2015/0007475 | A1 | 1/2015 | Hasler | |
| 2015/0107144 | A1 | 4/2015 | DiChario | |
| 2015/0192384 | A1 | 7/2015 | Ballard | |
| 2015/0247695 | A1 | 9/2015 | Jarboe | |
| 2015/0377575 | A1 | 12/2015 | Potter et al. | |
| 2015/0377584 | A1 | 12/2015 | Chvala | |
| 2016/0003576 | A1 | 1/2016 | Spykerman et al. | |
| 2016/0047623 | A1 | 2/2016 | Frankel | |

FOREIGN PATENT DOCUMENTS

| | | | |
|---|---|---|---|
| EP | 2791611 | A1 | 10/2014 |
| EP | 2828604 | A1 | 1/2015 |
| ES | 2548151 | T3 | 10/2015 |
| GB | 2485166 | A | 5/2012 |
| WO | 2015186017 | A1 | 12/2015 |
| WO | 2015200588 | A1 | 12/2015 |

OTHER PUBLICATIONS

Kasten, Klaus, "Extended European Search Report Re Application No. 16182255.6", dated Dec. 12, 2016, p. 8.

* cited by examiner

MAGAZINE WELL FOR A FIREARM

CROSS-REFERENCE TO RELATED APPLICATIONS

This application claims priority to U.S. Provisional Application No. 62/199,597 filed on Jul. 31, 2015, and entitled "MAGAZINE WELL FOR A FIREARM," the entire disclosure of which is hereby incorporated by reference for all proper purposes.

BACKGROUND

Field

The present invention relates generally to firearms, and more specifically to magazine wells for firearms.

Background

Bolt action type rifles, with a long history of use, are typically considered to be one of the most accurate types of rifles, and are often used as sniper and precision platforms; however, users who convert a bolt action type rifle into a rifle suitable for use with a detachable box magazine generally inadvertently introduce additional tolerance stack-up, resulting in a weapon that may feed unreliably.

In a typical Remington 700 Long Action rifle with a currently-available aftermarket bottom metal, the stability of the magazine is controlled by the magazine body to bottom metal interface, the trigger guard to stock interface, and the trigger guard to action interface. The trigger guard to stock interface controls the height of the bottom metal, and affects the fore-aft and lateral placement of the magazine. Specifically, if the stock is inletted off center, then lateral placement of the trigger guard is adversely affected; if the stock inletting is improperly placed longitudinally, then the fore- and aft-placement of the magazine is adversely affected. Moreover, even though mounting screws that attach the trigger guard to the stock are the primary interface with the stock, there generally remains some room for relative movement or shifted alignment, which is affected by the trigger guard to stock interface. That is, the trigger guard to stock interface can vary significantly, given that this interface is affected by the competence of the gunsmith, often a hobbyist, performing the necessary inletting work on the stock. Those skilled in the art will understand that attachment of the aftermarket bottom metal requires that the rifle be modified by the gunsmith. In the case of a wooden stock, the trigger guard to stock interface may further be affected by warpage of the wood over time and/or due to varying weather conditions, particularly in moist environments. The trigger guard to action interface primarily controls the fore-aft and lateral placement of the bottom metal. Because so many interfaces control the stability of the magazine, the tolerance stack-up can result in excessive relative movement between the components and an inherent reduction in reliability of the firearm.

Other firearms, such as the Remington 700 Short Action and/or completely unrelated platforms such as the M16, may also result in an excessive tolerance stacking.

Moreover, bolt action type rifles, such as the Remington 700 Long Action, may be designed with a relatively long and narrow bottom metal feature that, while replaceable for repair, results in a shape that generally would allow detachable box magazines and/or replacement bottom metals having a magazine receiving well, if installed, to more readily rock within the receiving space for the bottom metal. That is, these firearms were not designed with a detachable box magazine being contemplated.

Therefore, there remains a need for a conversion kit or component that allows a user to convert a bolt action type rifle into one that accepts a detachable box magazine, while maintaining reliable functionality.

SUMMARY

Embodiments disclosed herein address the above stated needs by providing a magazine well unit as herein described.

In one example, a magazine well unit for a firearm is disclosed. The exemplary magazine well unit may have an upper portion having a firearm interface, a lower portion, a proximal portion, a distal portion having a magazine well to removably receive a box magazine. The magazine well may have at least one fore stop and at least one aft stop. The at least one fore stop and the at least one aft stop may be shaped to prevent the box magazine from passing beyond the upper portion of the magazine well unit. At least one of the at least one fore stop or the at least one aft stop may have an upper portion region having a surface for engaging the firearm.

In another example, a method of retrofitting a rifle is disclosed. The exemplary method may include removing a factory bottom metal from the rifle, and coupling a magazine well unit to the rifle. The magazine well unit may include (a) an upper portion having a firearm interface; (b) a lower portion shaped to receive a box magazine; (c) a proximal portion; and (d) a distal portion having a magazine well. The magazine well may include at least one fore stop and at least one aft stop, the at least one fore stop and the at least one aft stop shaped to prevent the box magazine from passing beyond the upper portion of the magazine well unit. At least one of the at least one fore stop or the at least one aft stop may include an upper portion region having a surface for engaging the firearm.

In another example, a conversion kit for a bolt action type firearm is disclosed. The exemplary conversion kit may include a magazine well unit having (a) an upper portion having a firearm interface, (b) a lower portion, (c) a proximal portion having a trigger guard, and (d) a distal portion having a magazine well to removably receive a box magazine. The magazine well may include at least one fore stop and at least one aft stop, at least one of the at least one fore stop or the at least one aft stop comprising a flange surface to prevent the box magazine from moving past the upper portion of the magazine well unit. The conversion kit may be configured to replace a factory bottom metal in the bolt action type firearm, and to provide a tolerance stack-up between the magazine and the firearm. The tolerance stack-up may consist of (a) an interface between the magazine and the magazine well, (b) an interface between the magazine and the lever, and (c) an interface between the magazine well and the firearm.

DETAILED DESCRIPTION

Figure 19:
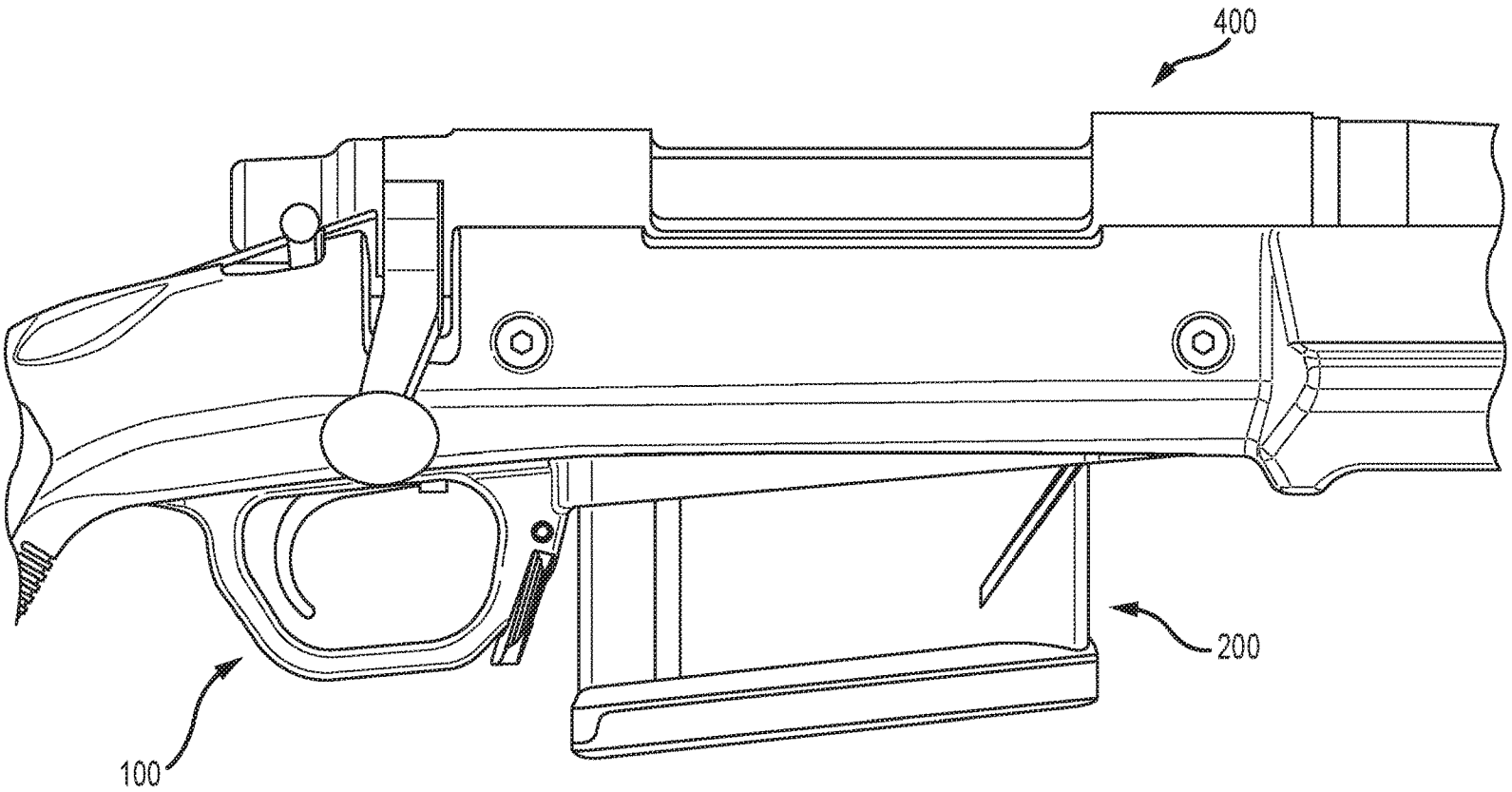
FIG. 19 is a first side view of the unit in FIG. 1 installed on a bolt action type rifle.

Turning now to the figures, where like reference numerals represent like or similar features, an exemplary magazine well unit 100, or unit 100, is now described in detail. In some embodiments, the unit 100 may be provided as a means for a user to convert a standard bolt action type rifle such as a Remington 700 Long Action rifle, as illustrated in FIG. 19, or a similarly configured firearm, into a rifle suitable for use with a box type magazine, although those skilled in the art will also recognize that the unit 100 may be used with other bolt action rifles or completely different platforms, regardless of action, such as the such as the M16/AR-series platform, other bolt action type rifles, or others. The unit 100 may replace the factory bottom metal of a bolt action type rifle to allow the use of a detachable box magazine. The word "exemplary" is used herein to mean "serving as an example, instance, or illustration." Any embodiment described herein as "exemplary" is not necessarily to be construed as preferred or advantageous over other embodiments.

Figure 1:
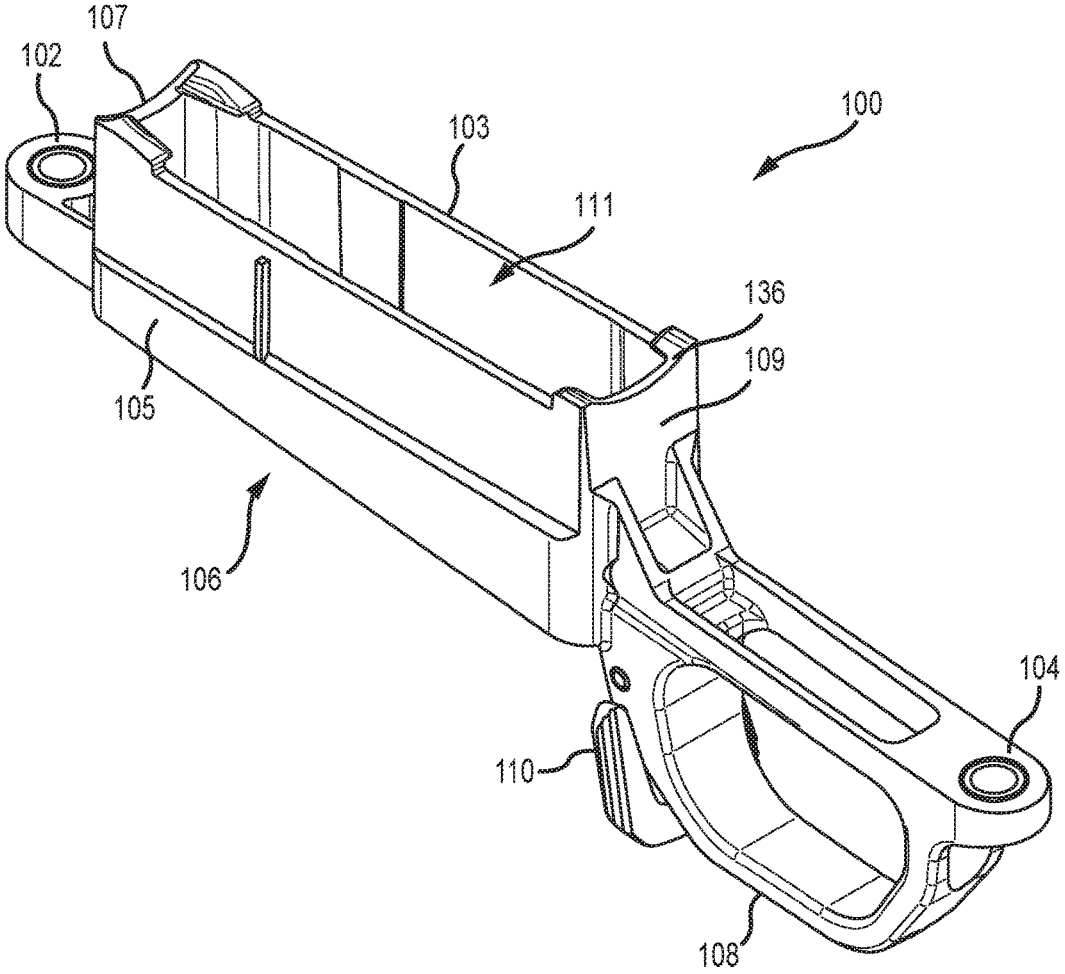
FIG. 1 is an isometric view of an exemplary trigger guard and magazine well unit.

With specific reference to FIG. 1, the unit 100 has a fore region 102, an aft region 104, and a magazine well 106. In some embodiments, the unit has a trigger guard 108. A lever 110 may be included to allow a user to lock or unlock a magazine in position relative to the unit 100. The magazine well may have a first side wall 103, a second side wall 105, a first end wall 107, and a second end wall 109, with the first and second side walls 103, 105 and the first and second end walls 107, 109 defining a magazine receiving space 111 therebetween. The at least one aft stop 118 and the second end wall 109 may have an upper portion having a concave surface 136 and shaped to engage the firearm receiver.

Figure 2:
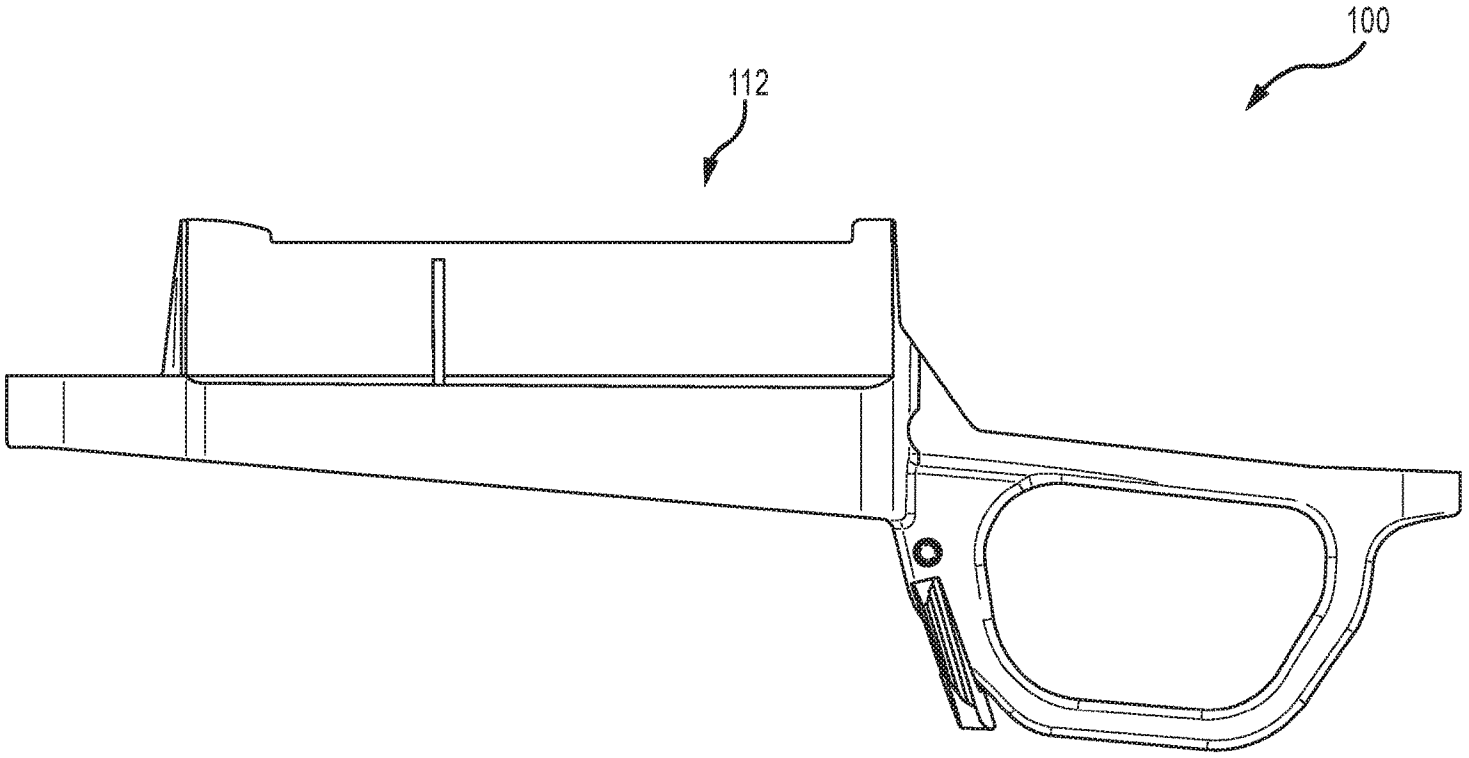
FIG. 2 is a first side view of the unit in FIG. 1.

With reference now to FIG. 2, the unit 100 includes an upper portion 112 that may have an interface for a firearm receiver. For the purpose of this document, the term "firearm receiver" shall be understood to mean those portions of a firearm assembly that mount or feed cartridges to a barrel, barrel assembly, or extensions thereof. Specifically, the firearm receiver shall be understood to be the upper receiver in an M16/AR-15 series firearm, the receiver 402 (see e.g. FIG. 20B) in a Remington 700 series firearm 400, or that portion of a firearm 400 that is shaped or configured to allow a cartridge 300 to initiate movement in a firing direction. That is, the upper portion 112 may be shaped so as to engage a firearm in a manner that allows an aftermarket magazine 200 (see FIG. 19) to reliably feed cartridges to the firearm 400 (see FIG. 19). The unit 100 may be attachable to the firearm 400 using fastening points designed for receiving factory standard bottom metal components that would normally be in place in a bolt action rifle (see FIG. 19). Those skilled in the art will understand that the upper portion 112 may be shaped to conform to any number of firearms or other weapons systems.

Figure 3:
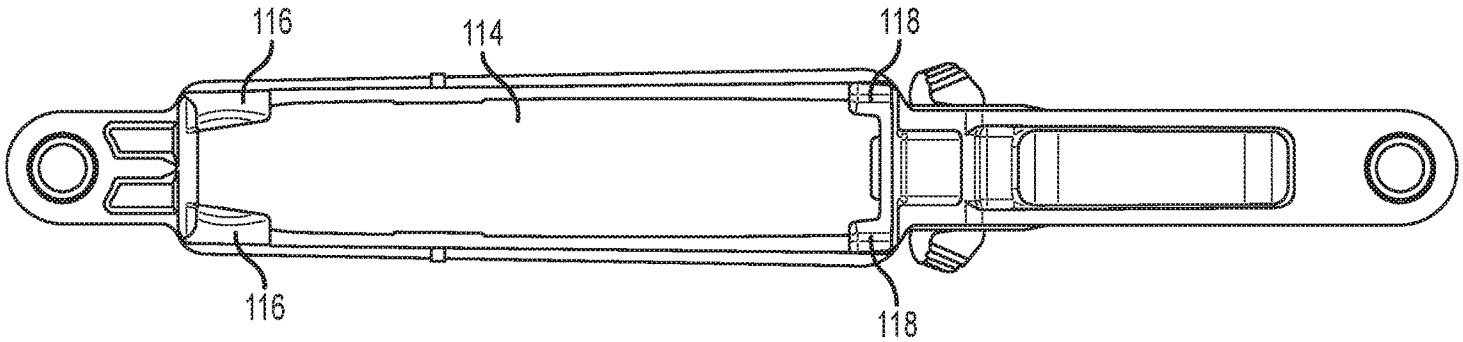
FIG. 3 is a top view of the unit in FIG. 1.
Figure 4:
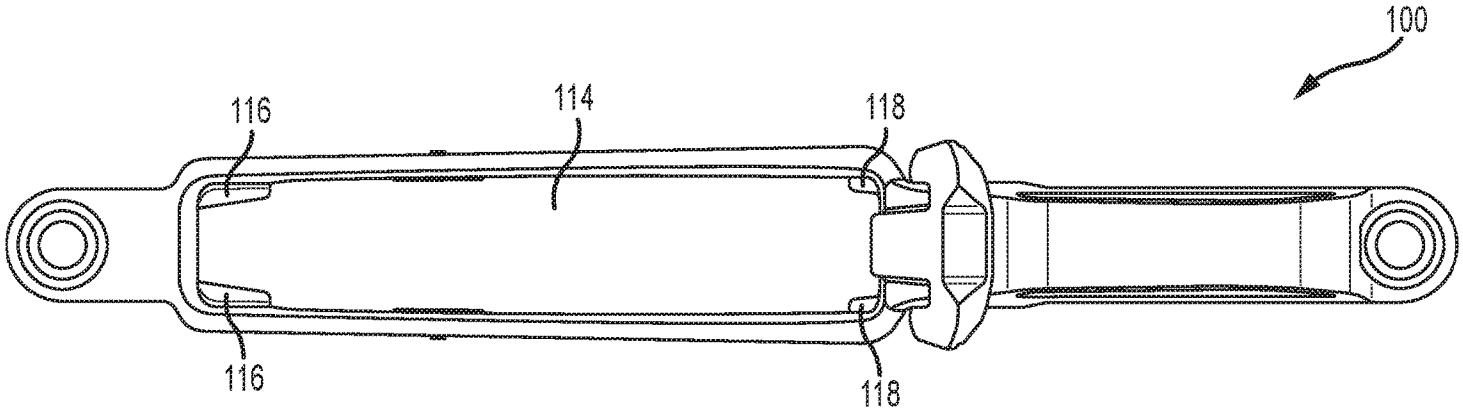
FIG. 4 is a bottom view of the unit in FIG. 1.

Turning now to FIGS. 3-4, the unit 100 may have one or more fore stops 116 and one or more aft stops 118. The fore and aft stops 116, 118 are provided to stop a box magazine from extending too far into an interior cavity 114 of the magazine well of the unit 100 (see FIG. 4) and/or the firearm, as well as to reduce a rotational movement of the magazine within the magazine well of the unit 100. More specifically, the fore and aft stops 116, 118 together provide a tight tolerance for attaching a magazine, thereby reducing the tolerance stack-up between the firearm and the cartridge feed components.

Figure 5:
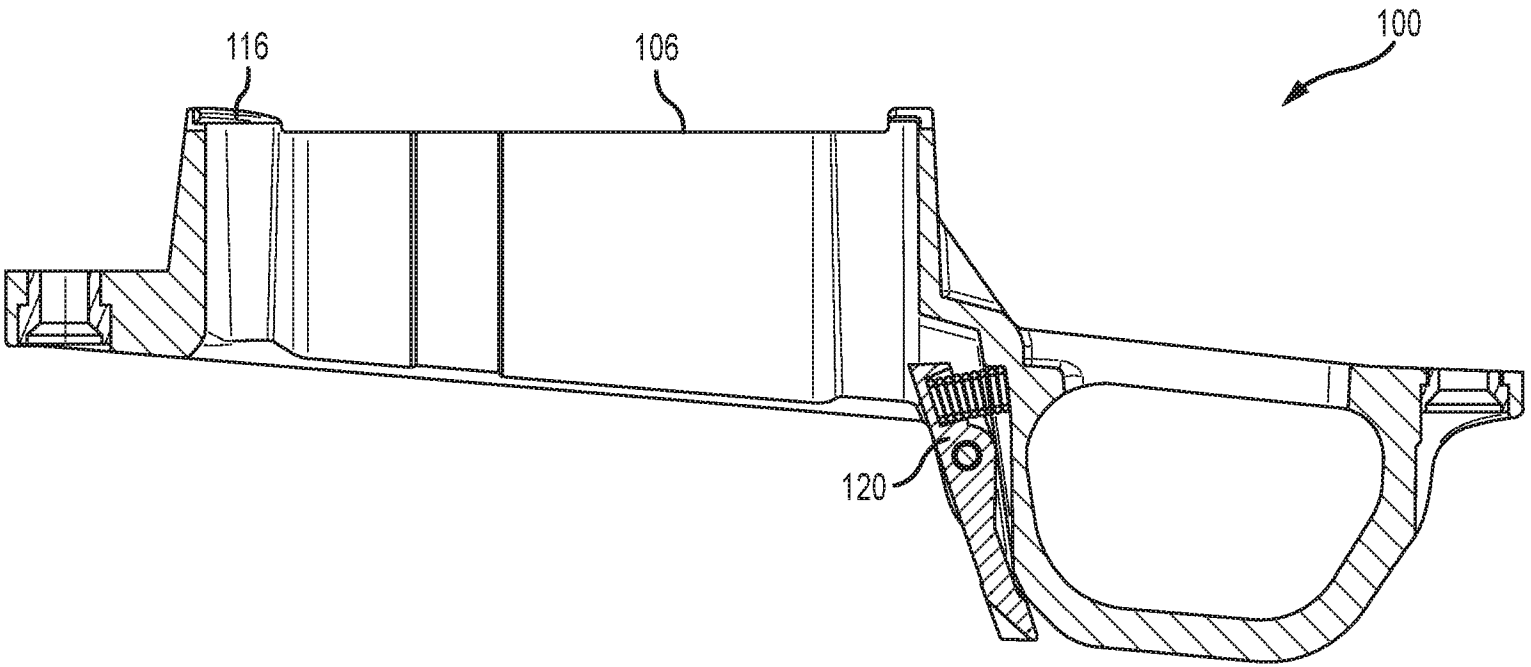
FIG. 5 is a side section view of the unit in FIG. 1.
Figure 14:
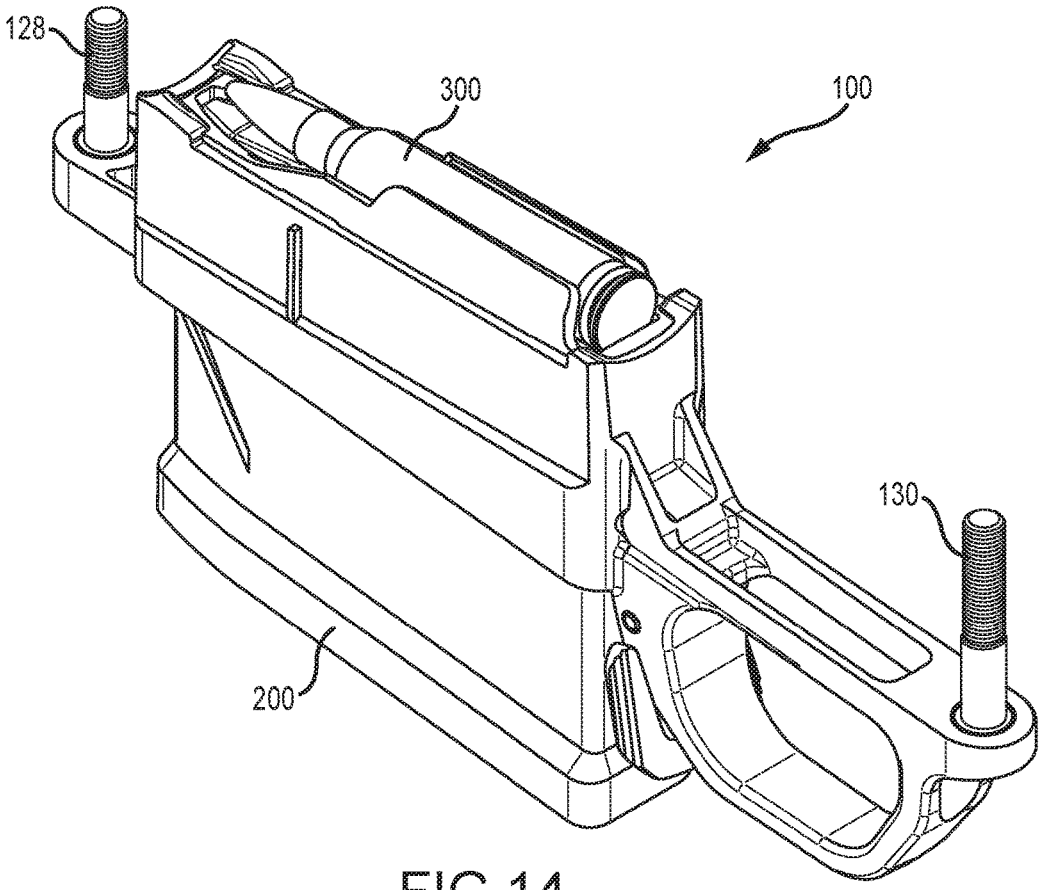
FIG. 14 is an isometric view of the unit in FIG. 1 assembled with a magazine and cartridge.
Figure 14A:
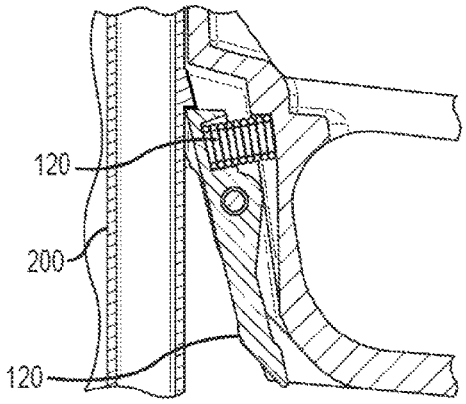
FIG. 14A is a first side section view illustrating some aspects of the assembly in FIG. 14.

As illustrated in FIG. 5, the lever 110 may releasably maintain a magazine attached to the unit 100 in a manner known to those skilled in the art. The lever 110 may be biased towards an engaged position by the spring 120 (see FIG. 1) to selectively allow a magazine to be inserted into the magazine well 106. That is, the lever 110 may be biased in an extended position as illustrated in FIG. 5. Insertion of a magazine 200 may cause the spring 120 to temporarily retract, until the spring 120 extends again to cause the lever 110 to engage a recess in the magazine 200, as illustrated in FIG. 14A. To allow disengagement of the magazine 200 from the unit 100, the lever 110 is pivoted about the pin 126 (see FIG. 6) to move out of engagement with the magazine 200 (not pictured in FIG. 6). Those skilled in the art will understand that the lever 110 (see FIG. 6) may be configured to require either a pull motion or a push motion to force disengagement from the magazine 200. In some embodiments, the magazine well 106 and/or lever 110 may provide sufficient support in some embodiments so as to maintain a magazine attached to, for example, a lower receiver of an AR-15 type or AR-15 variant rifle without allowing significant relative motion between the magazine and the lower receiver (not illustrated).

Figure 6:
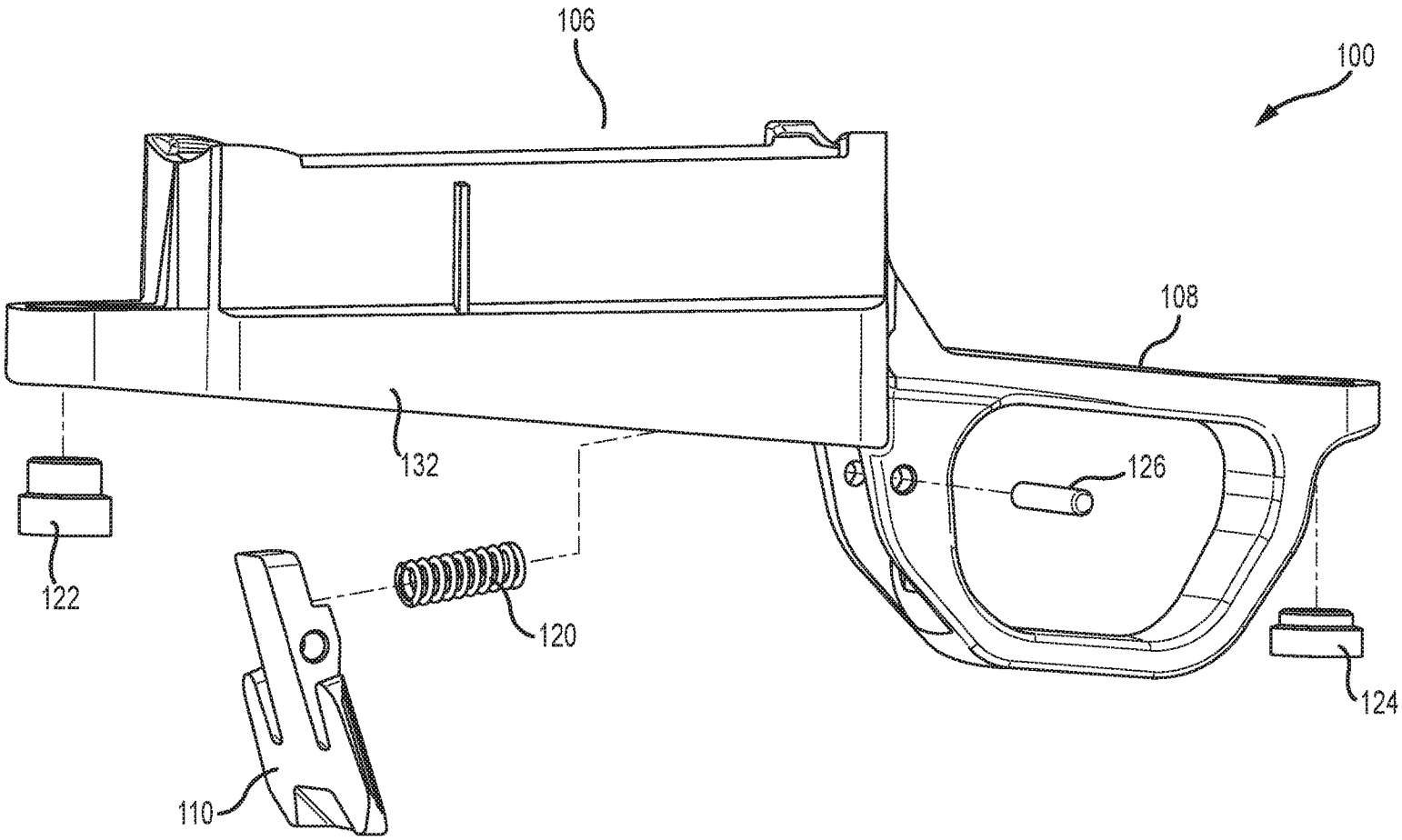
FIG. 6 is an isometric exploded view of the unit in FIG. 1.

Continuing with FIG. 6, the unit 100 may further include a fore fastener interface 122 and an aft fastener interface 124. The fastener interfaces 122, 124 may be made of a metallic or other suitably strong material such as a steel, so that the main body 132 of the unit 100 may be made of a polymeric or other lightweight material, such as a reinforced polymer. The fastener interfaces 122, 124 may be press fit into the main body 132 to provide a female portion or passage for one or more fasteners 128, 130, as illustrated in FIG. 14. Similarly, the lever 110 may be made of a metallic material such as a cast steel for strength and durability, and pivotally coupled to the main body 132 using a press fit pin 126.

Figure 7:
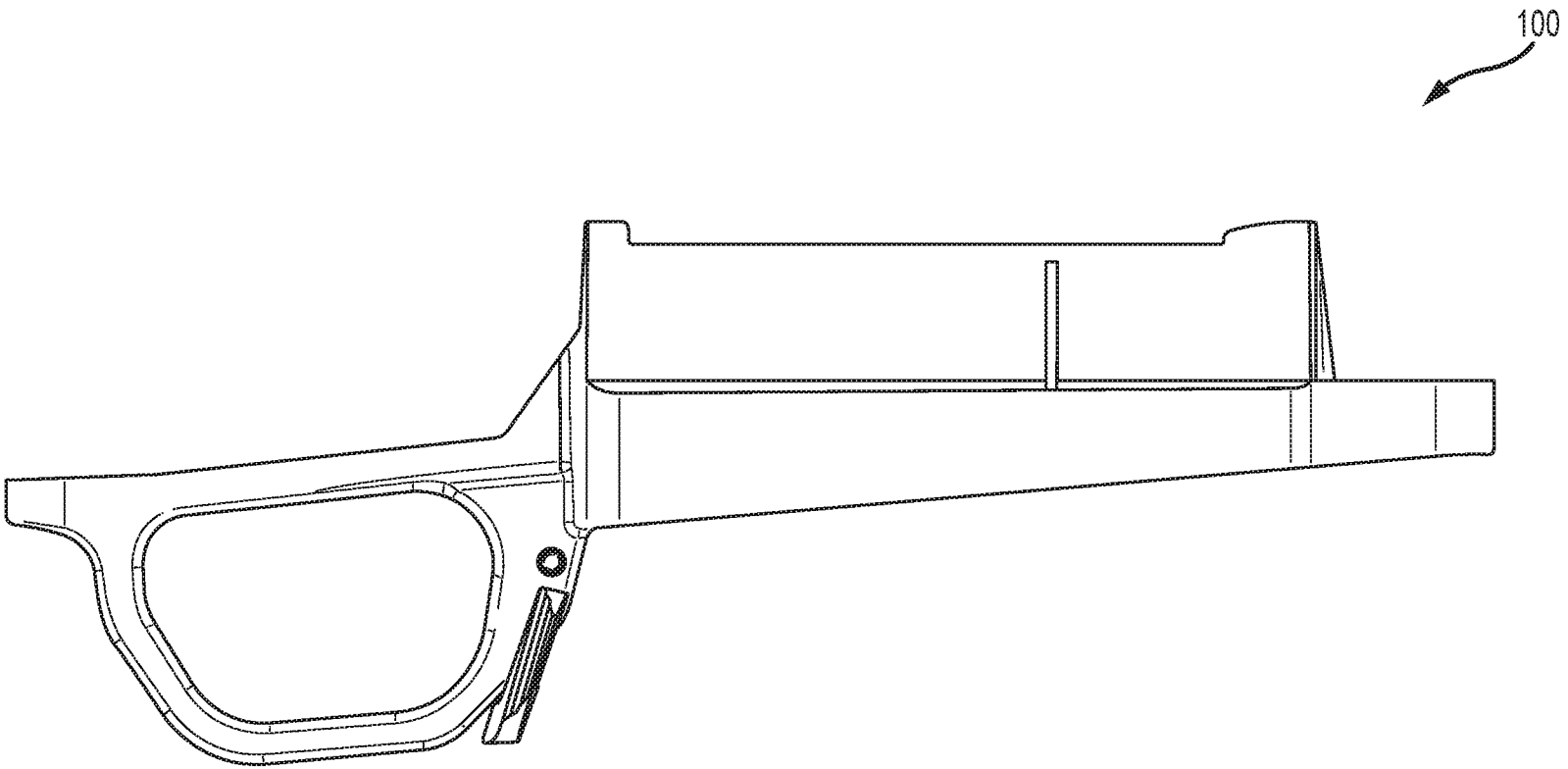
FIG. 7 is a second side view of the unit in FIG. 1.

As illustrated in FIG. 7, the unit 100 may have an opposing side that is a substantially identical mirror image of the first side, although this is not required.

Figure 8:
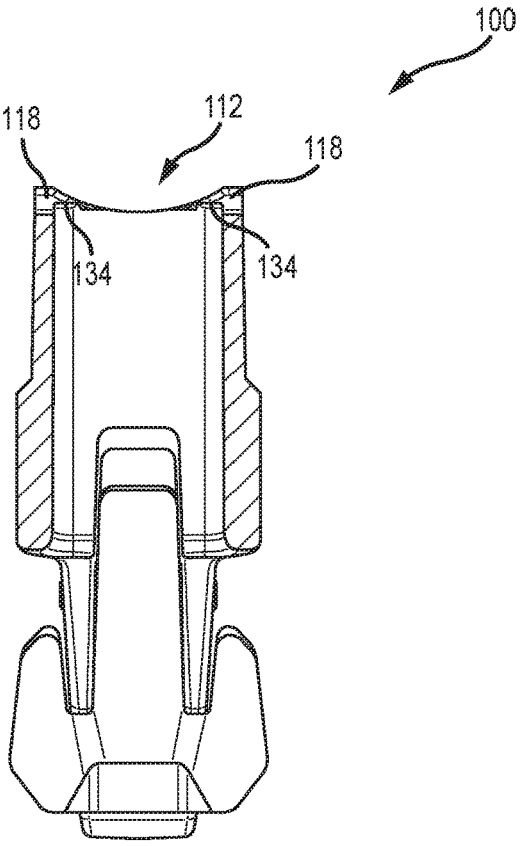
FIG. 8 is a rear section view of the unit in FIG. 1.
Figure 9:
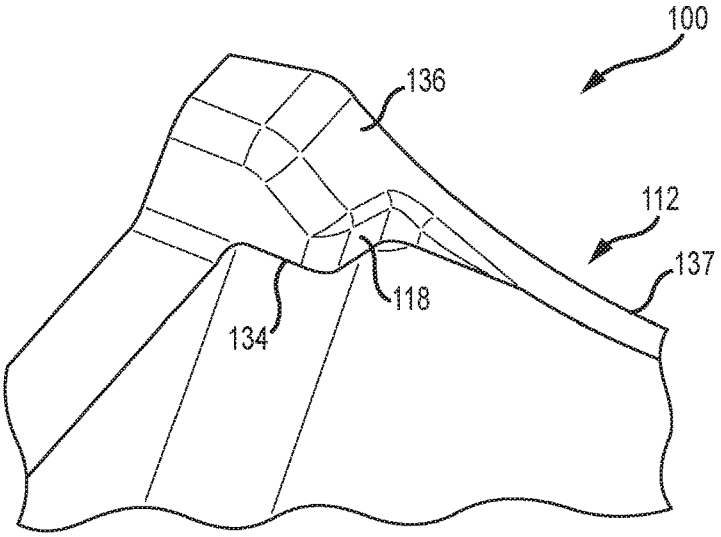
FIG. 9 is a detailed view illustrating some aspects of the unit in FIG. 1.
Figure 13:
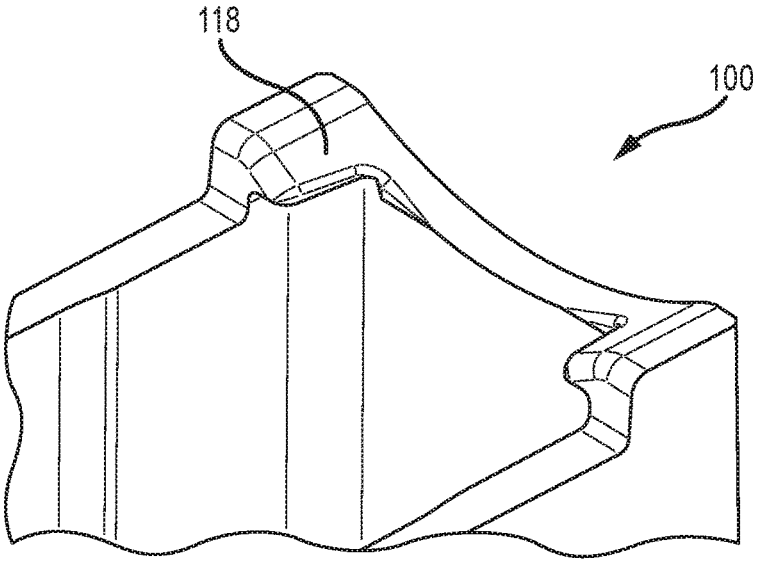
FIG. 13 is a detailed view illustrating some aspects of the unit in FIG. 1.

Turning now to FIGS. 8-9, and 13, which illustrate a cross section of the unit 100 and details of the aft stops 118 respectively, one or more of the aft stops 118 may be shaped and positioned to provide both a stop flange 134 against which a magazine 200 (not pictured) may abut when installed and an upper portion region 136 for engaging the firearm. That is, as illustrated in FIG. 13, the upper portion 112 may generally comprise the upper portion region 136 of the aft stop(s) 118 and a second end wall 137 to suitably engage the firearm.

Figure 10:
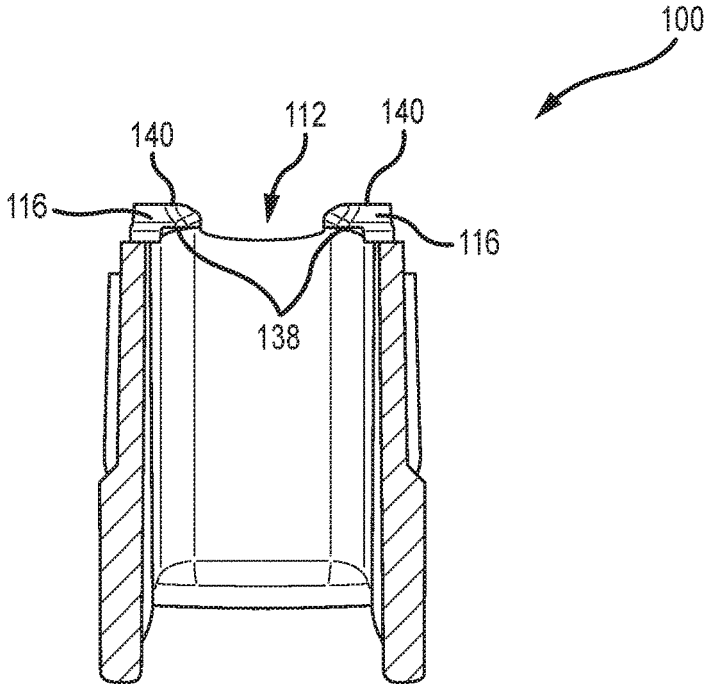
FIG. 10 is a front section view of the unit in FIG. 1.
Figure 11:
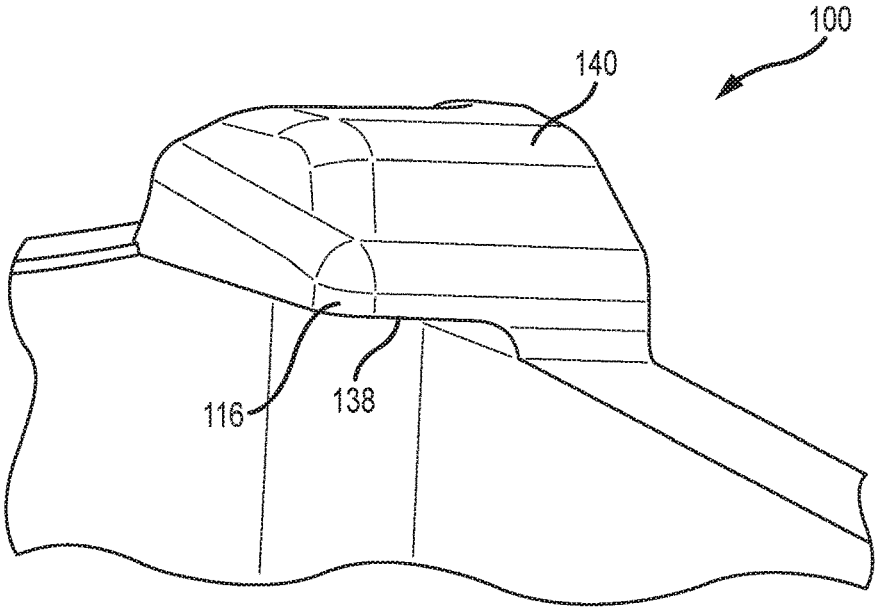
FIG. 11 is a detailed view illustrating some aspects of the unit in FIG. 1.
Figure 12:
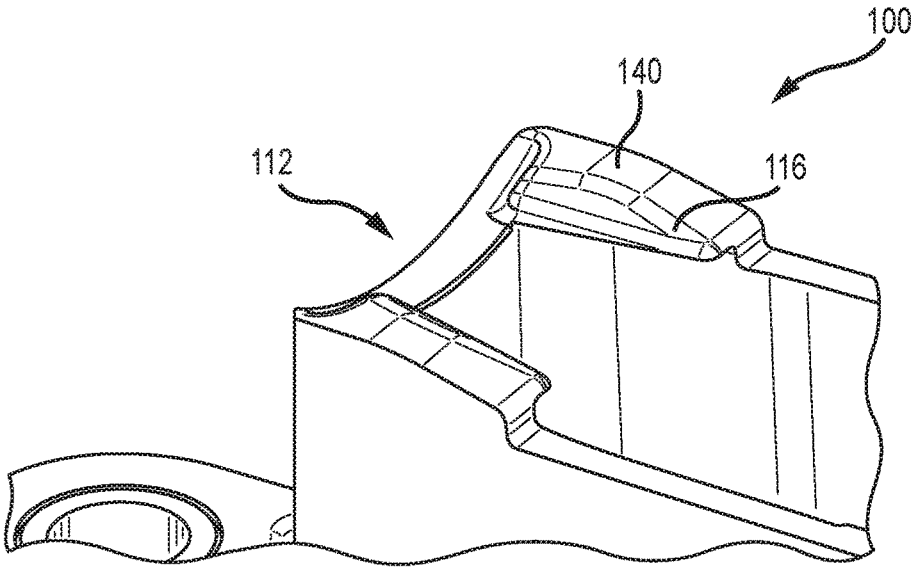
FIG. 12 is a detailed view illustrating some aspects of the unit in FIG. 1.

Turning now to FIGS. 10-12, which illustrate a cross section of the unit 100 and details of the fore stops 116 respectively, one or more of the fore stops 116 may be shaped and positioned to provide both a stop flange 138 against which a magazine 200 may abut when installed and an upper portion region 140 for engaging the firearm. That is, the upper portion 112 may generally comprise the upper portion region 140 of the fore stop(s) 116 to suitably engage the firearm.

Together, the fore and aft stops 116, 118 may be shaped and positioned to position a magazine 200 in the magazine well 106 such that a leading cartridge 300 does not dive excessively relative to a longitudinal axis of the firearm 400, as illustrated in FIG. 14.

Put succinctly, the upper portion regions 136, 140 of the fore and aft stops 116, 118 provide a clean engagement with the firearm 400, while the stop flanges 134, 138, provide a consistent stop feature for a magazine 200 being installed, thereby reducing the tolerance stack-up and potential for misfeeding of the cartridge. As previously described, the magazine stability is controlled in currently-available after-market bottom metals by a combination of the magazine body to magazine well interface, the trigger guard to stock interface, and the trigger guard or magazine well to action interface.

In contrast, the unit 100 herein described controls magazine stability using primarily the magazine body to magazine well 106 interface, resulting in a more reliable interface and reducing the chances of misfeeding the cartridge. Specifically, in some embodiments, the unit 100 may be shaped so as to limit a tolerance stack-up between the box magazine 200 and the rifle or firearm 400 to consist primarily of an interface between the box magazine 200 and the magazine well 106. In some embodiments, the unit 100 is configured to provide a tolerance stack-up between the magazine 200 and the firearm 400 that consists of (a) an interface between the magazine 200 and the magazine well 106, (b) an interface between the magazine 200 and the lever 110, and (c) an interface between the magazine well 106 and the firearm 400.

Figure 15:
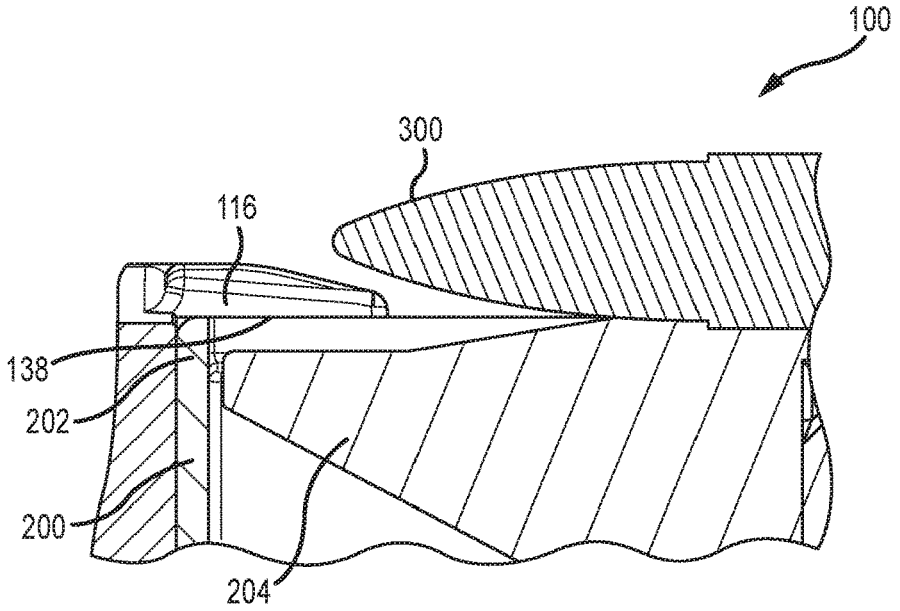
FIG. 15 is a detailed first side section view illustrating some aspects of the assembly in FIG. 14.

FIG. 15 is a cross section view illustrating some details of the interface between the unit 100, the magazine 200, and a cartridge 300. The fore stop 116 is shown with an upper portion 202 of a box magazine 200 abutting the stop flange 138 in the unit 100. The cartridge 300 is also in a feed position, biased towards the feed position by a magazine follower 204.

Figure 16:
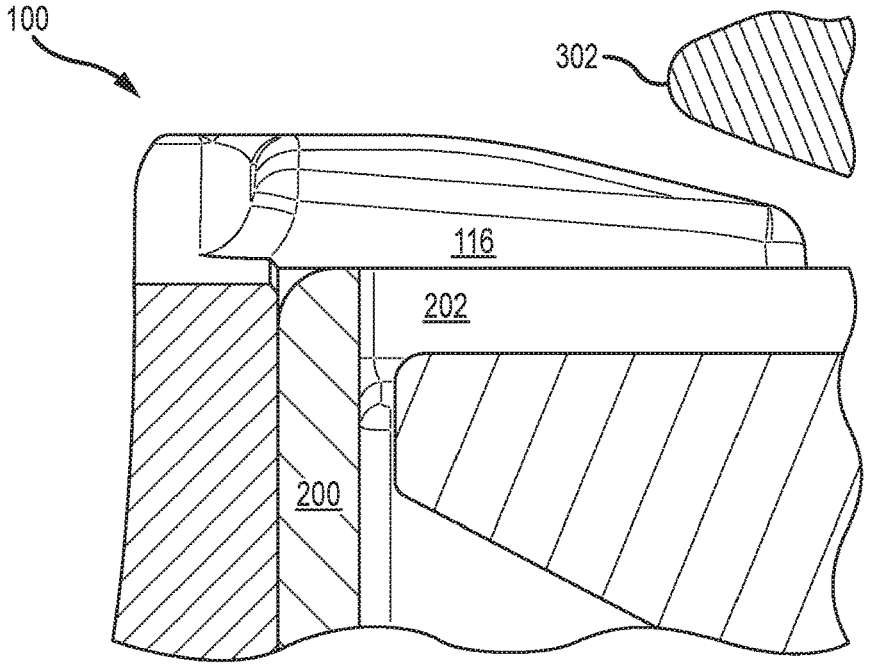
FIG. 16 is a detailed first side section view illustrating some aspects of the assembly in FIG. 14.

FIG. 16 illustrates more detailed aspects of the assembly in FIG. 15.

Figure 17:
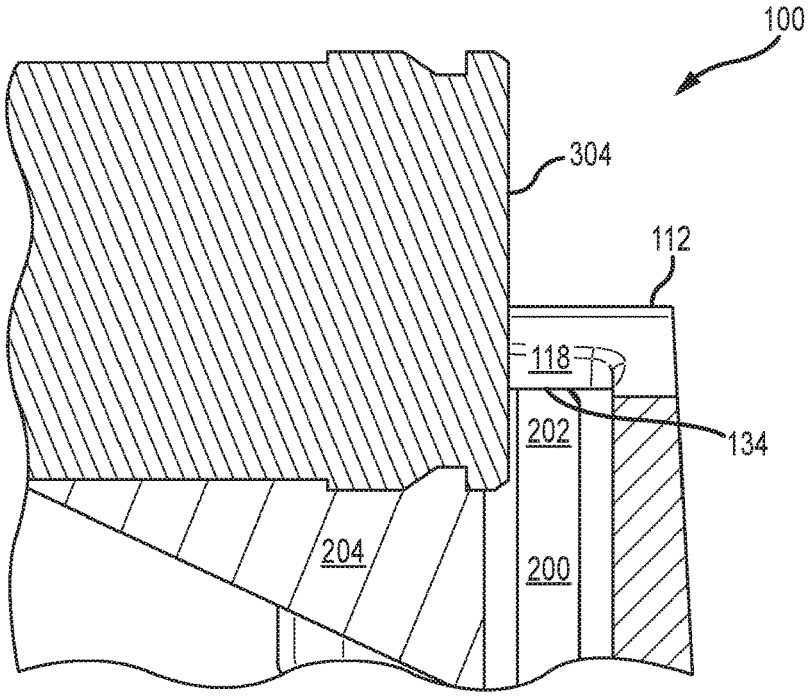
FIG. 17 is a detailed first side section view illustrating some aspects of the assembly in FIG. 14.
Figure 18:
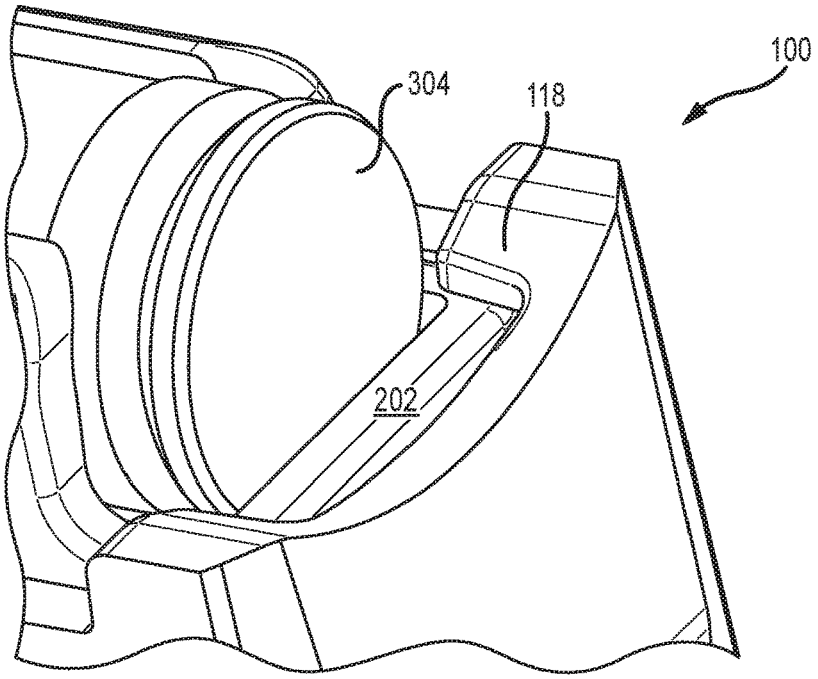
FIG. 18 is a detailed isometric view illustrating some aspects of the assembly in FIG. 14.

FIGS. 17-18 illustrate a rear portion of the assembly in FIG. 15. Specifically, the upper portion 202 of the magazine 200 is illustrated abutting the stop flange 134 in the aft stop 118, with the rear portion 304 of the cartridge 300 in a feed position.

FIG. 19 illustrates the unit 100 installed with a magazine 200 on a bolt action type firearm 400, such as a Remington 700 Long Action type firearm.

Figure 20A:
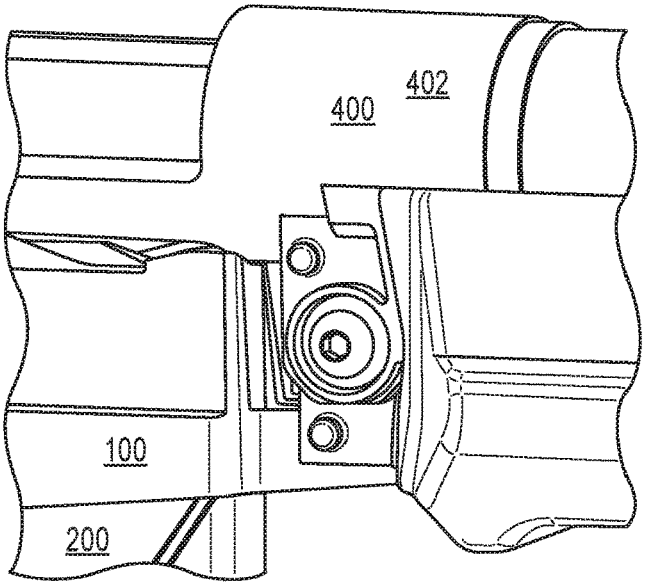
FIG. 20A is a detailed view illustrating some aspects of the assembly in FIG. 19.
Figure 20B:
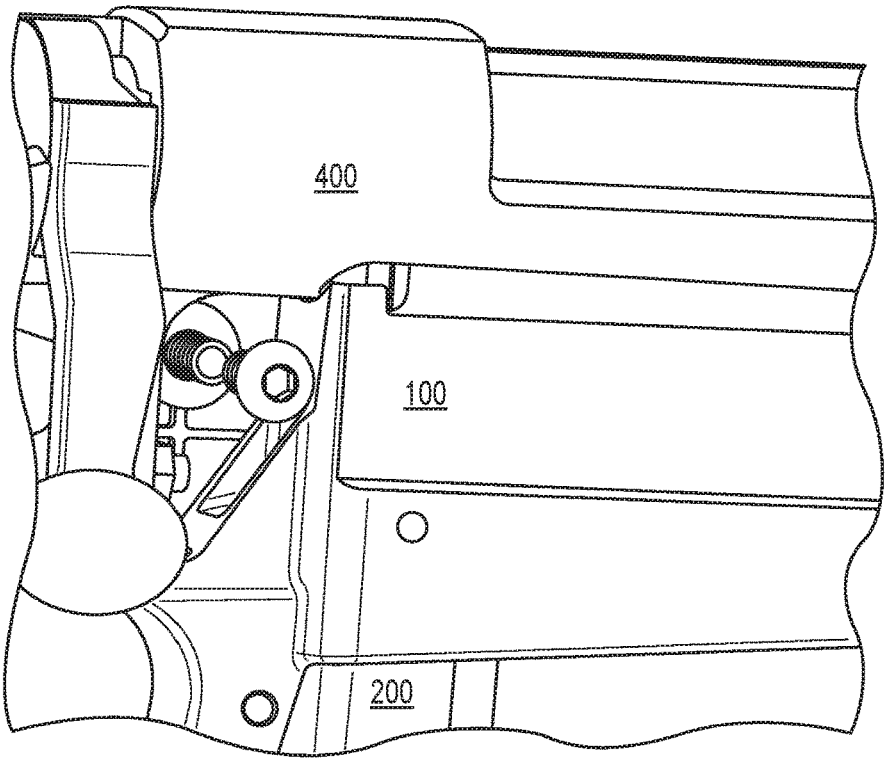
FIG. 20B is a detailed view illustrating some aspects of the assembly in FIG. 19.

FIGS. 20A-20B illustrate some details of how the unit 100 interfaces with the firearm 400 (note: some components of the firearm 400 are removed for clarity).

With reference to the preceding figures, those skilled in the art will recognize that, although the unit 100 has been illustrated in use with a bolt action type rifle, such as the Remington 700L rifle, the unit 100 could also be used on an AR type rifle platform, and provide substantially the same or similar benefits, such as a reduction in tolerance stack-up, as well as preventing relative movement between the magazine and other components, even if the lower receiver is disconnected.

Continuing with reference to the figures referenced above, those skilled in the art will also recognize that, in some embodiments or embodiments of use, detachable box magazines 200 that protrude from the firearm are sometimes used hastily as monopods to help stabilize the weapon. Historically, soldiers were taught to avoid using the box magazine 200 in this manner, as such use can damage the magazine 200 (direct impact, locking mechanism damage) and cause failures to feed (due to the shifting position of the looser magazines under load).

However, because a more stable magazine interface, such as that disclosed herein and/or provided by the unit 100, may be more tolerant of shifting loads (since it restricts the amount of free play in the system), some embodiments provide a system 100 and/or method of using a magazine 200 as one would use a monopod. Such embodiments may be useful for non-precision applications, as these type of weapons would typically either use dedicated support (bipod, tripod, separate monopod) mounted in more ideal locations or be set up with more optimal expedient support (sand bags, backpacks, supportive shooting positions, available terrain, etc.).

Figure 21:
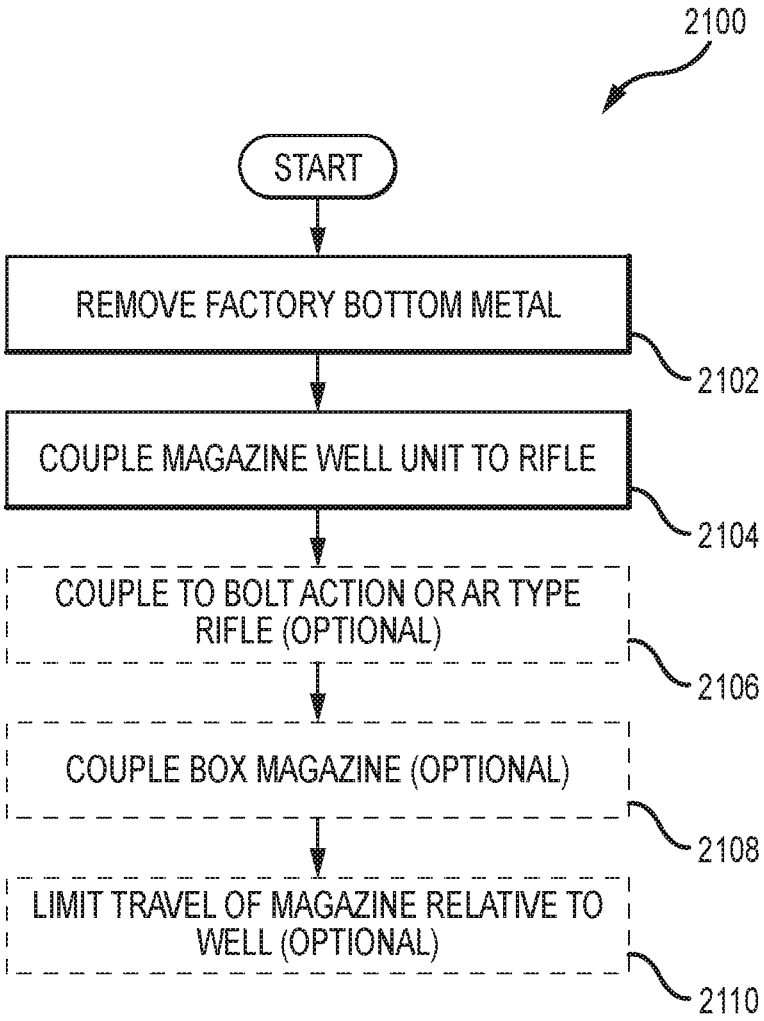
FIG. 21 is a flowchart of a method.

Turning now to FIG. 21, a method 2100 of retrofitting a rifle is now described. The method 2100 includes: removing 2102 a factory bottom metal from the rifle, and coupling 2104 a magazine well unit to the rifle. In some embodiments of the method 2100, the magazine well unit has (a) an upper portion having a firearm interface; (b) a lower portion shaped to receive a box magazine; (c) a proximal portion; and (d) a distal portion having a magazine well. The magazine well may have at least one fore stop and at least one aft stop, the at least one fore stop and the at least one aft stop shaped to prevent the box magazine from passing beyond the upper portion of the magazine well unit. At least one of the at least one fore stop or the at least one aft stop comprises an upper portion region having a surface for engaging the firearm.

The method 2100 may also include coupling a box magazine to the magazine well unit, wherein coupling the box magazine to the magazine well unit comprises causing the box magazine to engage a release lever in the magazine well unit.

The method 2100 may also include one or more of the following: coupling 2106 the magazine well unit to one of a bolt action type rifle or an AR platform type rifle; coupling 2108 a box magazine to the magazine well unit; causing the at least one fore stop and the at least one aft stop to limit travel of the box magazine relative to the magazine well, or limiting 2110 travel of the magazine (or box magazine) relative to the magazine well; and causing the box magazine to engage the magazine well and a release lever, and no other components of the firearm or magazine well unit.

In some embodiments, the method 2100 includes causing a tolerance stack-up between the magazine and the firearm to consist of (a) an interface between the magazine and the magazine well, (b) an interface between the magazine and the lever, and (c) an interface between the magazine well and the firearm. In some embodiments, the method 2100 includes causing a tolerance stack-up between the magazine and the firearm to consist primarily of an interface between the magazine and the magazine well.

In some embodiments, the method 2100 provides a no-gunsmithing means of retrofitting a rifle with a magazine well unit to reduce tolerance stack-up between a magazine and the rifle. For the purpose of this document, the term "no-gunsmithing means" shall be understood to mean a means that does not involve drilling or machining features in a factory-provided firearm.

Embodiments of the invention can be embodied in a variety of ways. In addition, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. As but one example, it should be understood that all action may be expressed as a means for taking that action or as an element which causes that action. Similarly, each physical element disclosed should be understood to encompass a disclosure of the action which that physical element facilitates. Regarding this last aspect, the disclosure of a "release mechanism" should be understood to encompass disclosure of the act of "releasing"—whether explicitly discussed or not—and, conversely, were there only disclosure of the act of "releasing", such a disclosure should be understood to encompass disclosure of a "release mechanism". Such changes and alternative terms are to be understood to be explicitly included in the description.

In conclusion, the present invention provides, among other things, a system and method for using a firearm magazine assembly. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A magazine well unit, the magazine well unit comprising:

an upper portion;

a lower portion;

a proximal portion; and a distal portion having a magazine well configured to removably receive a box magazine; wherein the magazine well comprises at least one fore stop and at least one aft stop, the at least one fore stop and the at least one aft stop shaped to prevent the box magazine from passing upward beyond a preselected position relative to the upper portion of the magazine well unit;

the upper portion has at least one surface for engaging the firearm receiver; and wherein the magazine well is shaped and configured for attachment to a bolt action rifle to convert the bolt action rifle to a rifle suitable for use with a box magazine.

2. The unit of claim 1, wherein:

the proximal portion comprises a trigger guard.

3. The unit of claim 1, wherein:

the magazine well comprises two fore stops and two aft stops.

4. The unit of claim 1, wherein:

the at least one surface for engaging the firearm receiver is concave.

5. The unit of claim 1, wherein:

the magazine well comprises a first side wall, a second side wall, a first end wall, and a second end wall, the first and second side walls and the first and second end walls defining a magazine receiving space therebetween;

the at least one fore stop comprises a stop flange coupled to at least one of the first side wall, the second side wall, or the second end wall; and the at least one fore stop comprises an upper portion region having a surface for engaging the firearm receiver.

6. The unit of claim 5, wherein:

the at least one aft stop comprises a stop flange coupled to at least one of a first side wall, a second side wall, or a first end wall.

7. The unit of claim 1, wherein:

the unit further comprises a magazine release lever for selectively engaging the box magazine;

the at least one fore stop and the at least one aft stop comprise stop flanges to limit travel of the box magazine relative to the magazine well; and wherein the box magazine only engages the magazine well and the magazine release lever.

8. The unit of claim 1, wherein:

the magazine well comprises a first side wall, a second side wall, a first end wall, and a second end wall, the first and second side walls and the first and second end walls defining a magazine receiving space therebetween; and the at least one aft stop and the first end wall comprise an upper portion having a surface shaped to engage the firearm receiver.

9. The unit of claim 8, wherein:

the at least one aft stop and the second end wall comprise an upper portion having a unitary concave surface and shaped to engage the firearm receiver.

10. The unit of claim 1, wherein:

the magazine well comprises a first side wall, a second side wall, a first end wall, and a second end wall, the first and second side walls and the first and second end walls defining a magazine receiving space therebetween; and the at least one fore stop and the second end wall comprise an upper portion having a concave surface and shaped to engage the firearm receiver.

11. The unit of claim 1, further comprising:

a lock configured to releasably maintain the box magazine coupled to the unit; and wherein the at least one fore stop and the at least one aft stop are configured to provide a clean engagement with the firearm; and the unit further comprises a tolerance stack-up between the box magazine and the bolt action rifle, the tolerance stack-up consisting of an interface between the box magazine and the magazine well.

12. The unit of claim 1, further comprising:

a trigger guard, and wherein:

the magazine well and the trigger guard are substantially comprised of a polymeric material.

13. A method of retrofitting a bolt action rifle, the method comprising:

removing a factory bottom metal from the bolt action rifle; and coupling a magazine well unit to the bolt action rifle, the magazine well unit comprising (a) an upper portion having an interface for a firearm receiver; (b) a lower portion shaped to receive a box magazine; (c) a proximal portion; (d) a distal portion having a magazine well; and (e) the magazine well is shaped and configured for attachment to a bolt action rifle to convert the bolt action rifle to a rifle suitable for use with a box magazine; wherein (i) the magazine well comprises at least one fore stop and at least one aft stop, the at least one fore stop and the at least one aft stop shaped to prevent the box magazine from passing upward beyond a preselected position relative to the upper portion of the magazine well unit; and (ii) the upper portion has at least one surface for engaging the firearm receiver.

14. The method of claim 13, wherein the proximal portion of the magazine well unit comprises a trigger guard, the method further comprising:

coupling the box magazine to the magazine well unit, wherein coupling the box magazine to the magazine well unit comprises causing the box magazine to engage a release lever in the magazine well unit.

15. The method of claim 13, further comprising coupling the box magazine to the magazine well unit; causing the at least one fore stop and the at least one aft stop to limit travel of the box magazine relative to the magazine well; and causing the box magazine to engage the magazine well and a lock, and no other components of the firearm or magazine well unit.

16. The method of claim 13, further comprising:

causing a tolerance stack-up between the magazine and the firearm to consist of (a) an interface between the magazine and the magazine well, (b) an interface between the magazine and the lock, and (c) an interface between the magazine well and the firearm receiver.

17. The method of claim 13, further comprising:

causing a tolerance stack-up between the magazine and the firearm to consist primarily of an interface between the magazine and the magazine well.

18. A conversion kit for a bolt action rifle, the conversion kit comprising:

magazine well unit having (a) an upper portion having an interface for a firearm receiver, (b) a lower portion, (c) a proximal portion having a trigger guard, (d) a distal portion having a magazine well to removably receive a box magazine, and (e) a lever for releasably maintaining the magazine coupled to the magazine well; and (f) the magazine well is shaped and configured for attachment to the bolt action rifle to convert the bolt action rifle to a rifle suitable for use with a box magazine wherein the magazine well comprises at least one fore stop and at least one aft stop, at least one of the at least one fore stop or the at least one aft stop comprising a flange surface to prevent the box magazine from passing upward beyond a preselected position relative to the upper portion of the magazine well unit; and wherein the conversion kit is configured to replace a factory bottom metal in the bolt action firearm, and to provide a tolerance stack-up between the magazine and the firearm, the tolerance stack-up consisting of (a) an interface between the magazine and the magazine well, (b) an interface between the magazine and the lever, and (c) an interface between the magazine well and the firearm receiver.

19. The conversion kit of claim 18; wherein the magazine well unit is shaped to replace a bottom metal in a bolt action rifle; and the upper portion has a surface for engaging the firearm receiver.

* * * * *